US008186107B2

(12) United States Patent
Silberman et al.

(10) Patent No.: US 8,186,107 B2
(45) Date of Patent: May 29, 2012

(54) CABLE DRIVE AND CONTROL SYSTEM FOR MOVABLE STADIUM ROOF PANELS

(75) Inventors: Cyril Silberman, Minnetonka, MN (US); Barton L. Riberich, Brooklyn Park, MN (US); Lennart Nielsen, Edina, MN (US); Michael Becker, New Hope, MN (US); Alan Wilcox, Rogers, MN (US); Timothy J. Kline, Minnetonka, MN (US); Neil Tolin, Buffalo, MN (US); Mark Silvera, Crystal, MN (US); Randy Grems, Fairbault, MN (US)

(73) Assignee: Uni-Systems, LLC, Minneapolis, MN (US)

( * ) Notice: Subject to any disclaimer, the term of this patent is extended or adjusted under 35 U.S.C. 154(b) by 531 days.

(21) Appl. No.: 11/367,563

(22) Filed: Mar. 3, 2006

(65) Prior Publication Data

US 2007/0017163 A1 Jan. 25, 2007

Related U.S. Application Data

(60) Provisional application No. 60/659,792, filed on Mar. 9, 2005.

(51) Int. Cl.

| | |
|---|---|
| ***E04H 3/10*** | (2006.01) |
| ***E04B 1/346*** | (2006.01) |
| ***A63C 19/00*** | (2006.01) |
| ***B65H 75/48*** | (2006.01) |

(52) U.S. Cl. ..... 52/6; 52/66; 472/92; 242/390.6

(58) Field of Classification Search ..... 52/6, 64, 52/66; 472/92; 242/390.6, 390.9, 413, 413.1, 242/413.3, 413.4, 413.5, 413.9, 414, 414.1
See application file for complete search history.

(56) References Cited

U.S. PATENT DOCUMENTS

| | | | | |
|---|---|---|---|---|
| 1,559,261 | A * | 10/1925 | Konsalik | 49/3 |
| 2,052,217 | A | 8/1936 | Sibour et al. | |
| 2,603,171 | A | 7/1952 | Smith | |
| 2,642,162 | A | 6/1953 | Tobias | |
| 2,921,592 | A * | 1/1960 | Mackey | 52/1 |
| 3,009,211 | A | 11/1961 | Hansen et al. | |
| 3,135,296 | A * | 6/1964 | Kelstrom et al. | 138/122 |
| 3,213,571 | A | 10/1965 | Olson | |
| 3,261,133 | A * | 7/1966 | Herr et al. | 296/213 |
| 3,266,328 | A * | 8/1966 | Rott | 74/89.17 |
| 3,277,619 | A * | 10/1966 | Miller et al. | 52/72 |

(Continued)

FOREIGN PATENT DOCUMENTS

JP 2-217539 A 8/1990

(Continued)

*Primary Examiner* — Eileen D Lillis
*Assistant Examiner* — Andrew Triggs
(74) *Attorney, Agent, or Firm* — Knoble Yoshida & Dunleavy, LLC

(57) ABSTRACT

A convertible stadium includes a playing field, a seating area, a stationary roof structure and a large, heavy roof panel mounted for movement with respect to the stationary roof structure, A plurality of cable drums are mounted for movement together with the roof panel. Each cable drum has at least one cable wound thereabout. The cable is secured to the stationary roof structure and is payable from the respective cable drum. The system is designed so as to minimize movement between the cable and the roof panel, so there will be no possibility of frictional engagement therebetween.

33 Claims, 10 Drawing Sheets

U.S. PATENT DOCUMENTS 3,288,158 A 11/1966 Gugliotta
3,436,132 A * 4/1969 Wiesler ..... 384/43
3,465,483 A * 9/1969 Miller ..... 52/72
3,534,511 A 10/1970 Cappella
3,579,932 A * 5/1971 Atkinson ..... 52/83
3,608,252 A 9/1971 Bisson
3,766,691 A 10/1973 Ray
4,175,361 A 11/1979 Kumode
4,177,973 A * 12/1979 Miller et al. ..... 254/276
4,257,199 A 3/1981 Kuboyama
4,347,993 A * 9/1982 Leonard ..... 242/413.3
4,348,833 A 9/1982 Nagoya
4,515,416 A * 5/1985 Teramachi ..... 384/45
4,569,164 A * 2/1986 Dickson ..... 52/64
4,581,860 A * 4/1986 Berger ..... 52/63
4,587,775 A 5/1986 Lewis et al.
4,616,451 A 10/1986 Glick
4,636,962 A * 1/1987 Broyden et al. ..... 700/228
4,676,033 A 6/1987 Allen et al.
4,682,449 A * 7/1987 Berger ..... 52/66
4,706,419 A 11/1987 Adachi et al.
4,716,691 A 1/1988 Allen et al.
4,727,688 A * 3/1988 Kida et al. ..... 52/6
4,738,057 A 4/1988 Logan
4,751,800 A 6/1988 Kida et al.
4,802,314 A 2/1989 Schildge, Jr.
4,804,095 A * 2/1989 Rohr et al. ..... 37/308
4,831,792 A * 5/1989 Berger ..... 52/66
4,833,837 A 5/1989 Bonneau
4,920,707 A 5/1990 Moskuliuk et al.
4,936,060 A 6/1990 Gelinas et al.
4,942,698 A 7/1990 Kumagai
4,995,203 A * 2/1991 Brisbin et al. ..... 52/6
5,007,214 A 4/1991 Itami et al.
5,010,695 A 4/1991 Schildge, Jr.
5,027,565 A 7/1991 Sugizaki
5,035,093 A 7/1991 Parazader et al.
5,058,332 A 10/1991 Masuyama et al.
5,062,243 A 11/1991 Kumagai
5,063,730 A * 11/1991 Muramoto et al. ..... 56/66
5,070,659 A * 12/1991 Brisbin et al. ..... 52/6
5,103,600 A 4/1992 Geiger et al.
5,115,127 A * 5/1992 Bobb et al. ..... 250/227.19
5,117,594 A 6/1992 Muramoto et al.
5,167,097 A 12/1992 Robbie et al.
5,187,894 A 2/1993 Ripley, Sr. et al.
5,189,851 A * 3/1993 Omika et al. ..... 52/66
5,203,125 A 4/1993 Sugizaki
5,257,481 A 11/1993 Reppas et al.
5,257,485 A 11/1993 Kawaguchi et al.
5,355,641 A * 10/1994 Levy ..... 52/66
5,371,983 A 12/1994 Kawaguchi et al.
5,394,659 A * 3/1995 Kawaguchi et al. ..... 52/66
5,394,660 A 3/1995 Haris
5,522,192 A * 6/1996 Frantl et al. ..... 52/206
5,622,013 A * 4/1997 Ban et al. ..... 52/83
5,653,066 A 8/1997 Schildge, Jr.
5,682,711 A 11/1997 Warczak
5,746,028 A 5/1998 DiBenedetto
5,778,603 A 7/1998 Reppas
5,848,499 A * 12/1998 Schildge, Jr. ..... 52/66
5,857,294 A * 1/1999 Castro ..... 52/81.2
5,875,281 A * 2/1999 Thexton et al. ..... 388/801
5,896,708 A 4/1999 Doi et al.
5,904,003 A * 5/1999 Stephen ..... 52/6
5,927,022 A 7/1999 Hirakawa et al.
5,983,575 A * 11/1999 Reppas ..... 52/66
6,003,269 A * 12/1999 McRee ..... 52/6
6,082,054 A * 7/2000 Silberman et al. ..... 52/66
6,145,254 A * 11/2000 Silva ..... 52/66
6,367,206 B1 * 4/2002 Silberman et al. ..... 52/66
6,385,912 B1 * 5/2002 Wessel et al. ..... 52/6
6,415,556 B1 * 7/2002 Silberman et al. ..... 52/66
6,698,141 B2 * 3/2004 Silberman et al. ..... 52/6
6,718,696 B2 * 4/2004 Silberman et al. ..... 52/6
6,754,994 B2 * 6/2004 Jahanpour ..... 52/66
6,768,321 B2 * 7/2004 Wain et al. ..... 324/699
6,789,360 B2 * 9/2004 Silberman et al. ..... 52/66
6,851,227 B1 * 2/2005 Schildge, Jr. ..... 52/66
2002/0129565 A1 * 9/2002 Silberman et al. ..... 52/66
2007/0017163 A1 * 1/2007 Silberman et al. ..... 52/41

FOREIGN PATENT DOCUMENTS

JP 2-269237 A 11/1990
JP 3-115632 A 5/1991
JP 4-323446 A 11/1992
NL 8006712 7/1982

* cited by examiner

CABLE DRIVE AND CONTROL SYSTEM FOR MOVABLE STADIUM ROOF PANELS

This application claims priority under 35 USC §119(e) based on U.S. Provisional Application Ser. No. 60/659,792, filed Mar. 9, 2005, the entire disclosure of which is hereby incorporated by reference as if set forth fully herein.

BACKGROUND OF THE INVENTION

1. Field of the Invention

This invention pertains, in general, to the field of retractable roofs for large structures, such as athletic stadiums. More specifically, the invention relates to an improved roof assembly that is optimal in terms of weight and bulk, that quickly adapts to maintain system alignment and balance during operation, that possesses fail-safe redundancy and that is economical to construct and to operate in comparison to conventional convertible stadium designs.

2. Description of the Related Technology

It is now common for athletic stadiums to be constructed with retractable roofs, because this type of construction offers spectators the pleasure of being outdoors on nice days, while providing shelter when necessary against extreme temperatures and inclement weather conditions. A retractable roof also can make possible the growth of natural grass within the stadium, which is often felt to be desirable in professional and major collegiate athletics.

A number of factors must be taken into account in the design of a stadium that has a retractable roof. For instance, the forces created by the exertion of natural forces such as wind, rain, snow and even earthquakes on such a large structure can be enormous, and the roof, the underlying stadium structure and the transport mechanism that is used to guide and move the roof between its retracted and operational positions must be engineered to withstand the worst possible confluence of such forces. Wind forces, for example, not only can impart tremendous displacement and lifting forces to a movable roof component, they can create potentially destructive vibration as well.

In addition, for reasons that are both aesthetic and practical, it is desirable to make the structural elements of the roof and the transport mechanism as unobtrusive and as space-efficient as possible. It is also desirable to make the roof structure and the transport mechanism as lightweight as possible, both to minimize the amount of energy that is necessary to open and close the roof structure and to minimize the need for additional structural reinforcement in the roof structure and in the underlying stadium structure.

Movable roof panels for large structures such as stadiums are still inevitably quite large and heavy and therefore present unique engineering challenges that are quite different than those that are faced by designers of smaller systems. For example, roof panels that are hundreds of feet in dimension undergo significant thermal expansion and contraction both on a macroscopic level as a result of atmospheric temperature conditions and on a more local level as a result of sunlight gradients, convection within and outside the stadium and so forth. For roof panels that are mounted for movement on trolleys or bearings that are significant distances from each other, thermal expansion and contraction present a significant engineering problem that is not faced by designers of smaller systems. Settling and shifting of the stadium and its foundation over time can also contribute to misalignment of large movable systems within the stadium such as roof panels. Maintaining the alignment of such systems during operation and while the systems are at rest is also an important consideration and presents challenges that are not present in smaller scale systems, especially when considered in conjunction with the external forces (wind shear, etc.) to which stadium roof panels are regularly subjected. It is desirable, of course, to minimize the mass and the weight of the bearing structure and the drive train that is used to support, reinforce and to move the movable roof panels between the opening and closed positions.

A need exists for an improved convertible stadium that is optimal in terms of weight and bulk, that quickly adapts to maintain system alignment and balance during operation, that possesses fail-safe redundancy and that is economical to construct and to operate in comparison to conventional convertible stadium designs.

SUMMARY OF THE INVENTION

It is therefore an object of the invention to provide an improved convertible stadium that is optimal in terms of weight and bulk, that quickly adapts to maintain system alignment and balance during operation, that possesses fail-safe redundancy and that is economical to construct and to operate in comparison to conventional convertible stadium designs.

In order to achieve the above and other objects of the invention, a movable roof system according to a first aspect of the invention includes a stationary roof structure; a large, heavy roof panel mounted for movement with respect to the roof structure; a cable drum mounted for movement with the roof panel; and a cable, the cable being secured to the stationary roof structure and being payable from the cable drum.

According to a second aspect of the invention, a convertible stadium, includes a playing field; a seating area; a stationary roof structure; a large, heavy roof panel mounted for movement with respect to said stationary roof structure; a plurality of cable drums, each of the cable drums being mounted for movement together with the roof panel, wherein each of the cable drums has at least one cable wound thereabout, the cable being secured to the stationary roof structure and being payable from the respective cable drum.

According to a third aspect of the invention, an anemometer includes an impeller; a flag mounted for movement with the impeller; light path means defining a light path, said light path means comprising an optical fiber and a space through which said flag is adapted to periodically travel, and analyzing means for analyzing light received from said light path means.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
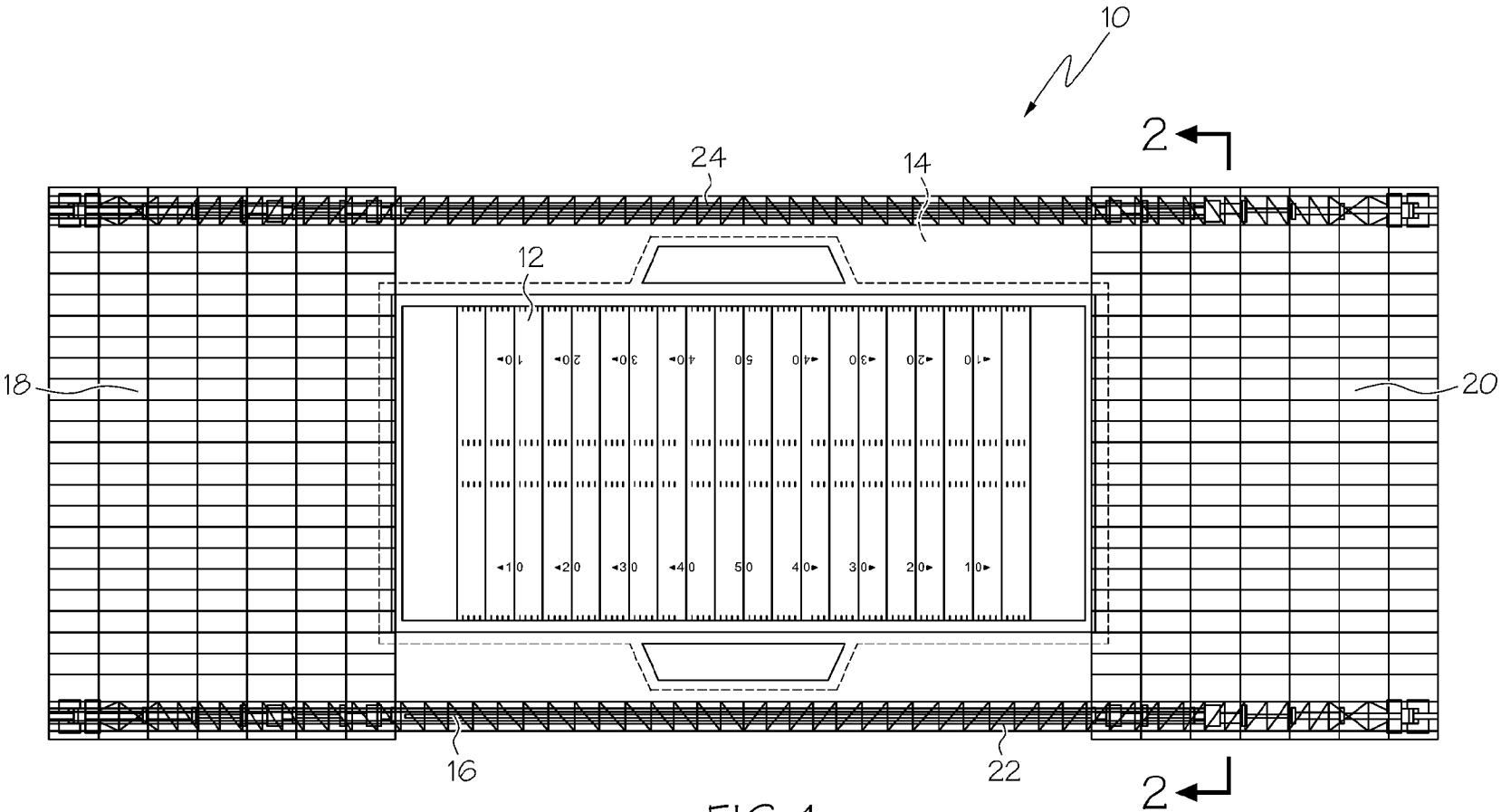
FIG. 1 is a top plan view of a convertible stadium that is constructed according to a preferred embodiment of the invention.

Referring now to the drawings, wherein like reference numerals designate corresponding structure throughout the views, and referring in particular to FIG. 1, a convertible stadium 10 according to a preferred embodiment of the invention includes a playing field 12 which in the preferred embodiment is an American football field, and a seating area 14 for spectators. Convertible stadium 10 is preferably what is generally considered to be a large stadium, i.e. a stadium that can accommodate over 40,000 spectators and that is suitable for professional sporting events such as National Football League games.

Convertible stadium 10 further preferably includes stationary roof structure 16, a first movable roof panel 18 and a second movable roof panel 20. The first and second movable roof panels 18, 20 are large, relatively heavy structures in engineering terms, having a length and a width of at least 100 feet in each dimension and a weight of at least 100 tons. Preferably, both the first and second movable roof panels 18, 20 are constructed as a lenticular truss as taught in U.S. Pat. No. 4,789,360 to Silberman et al., the disclosure of which is incorporated by reference as if set forth fully herein.

Figure 2:
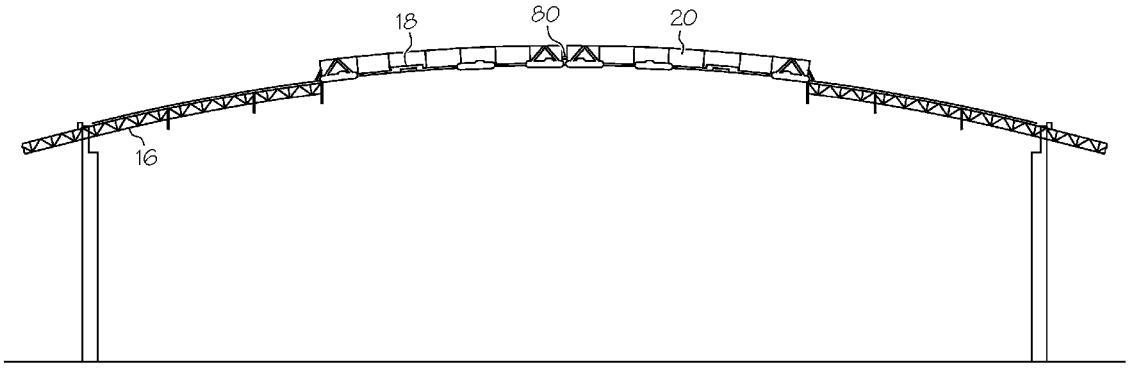
FIG. 2 is a cross-sectional view of the convertible stadium depicted in FIG. 1, shown in a closed position.
Figure 3:
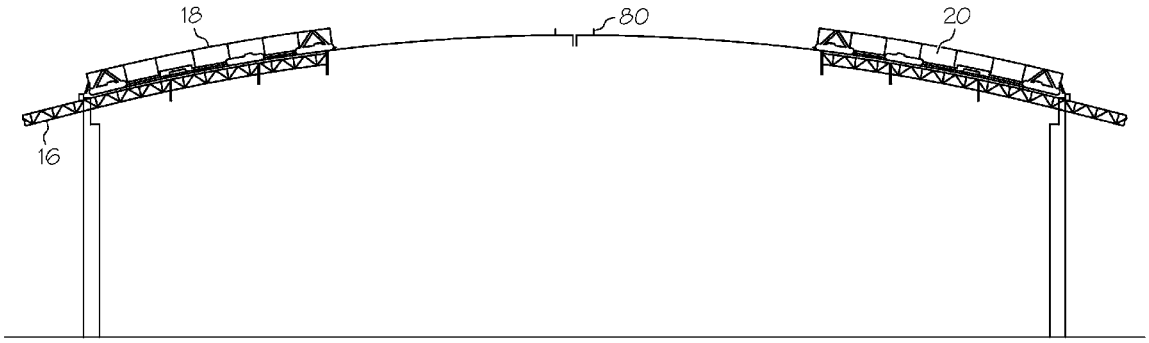
FIG. 3 is a cross-sectional view of the convertible stadium depicted in FIG. 1, shown in an open position.

As is shown in FIGS. 2 and 3, first and second movable roof panels 18, 20 are both movably mounted on the stationary roof structure 16 so as to be movable along a path between a first fully open position as is depicted in FIGS. 1 and 3 and a second fully closed position as is depicted in FIG. 2, or in any of an infinite number of intermediate positions therebetween. In the fully open position, convertible stadium 10 is effectively an outdoor stadium, while in the fully closed position convertible stadium 10 is effectively an indoor stadium. Preferably, the first and second movable roof panels 18, 20 are constructed and arranged to travel a distance of at least 50 feet between the fully open position and the fully closed position. In the preferred embodiment, the first and second movable roof panels 18, 20 are constructed and arranged to travel a distance of approximately 182 feet between the fully open and fully closed positions.

Figure 4:
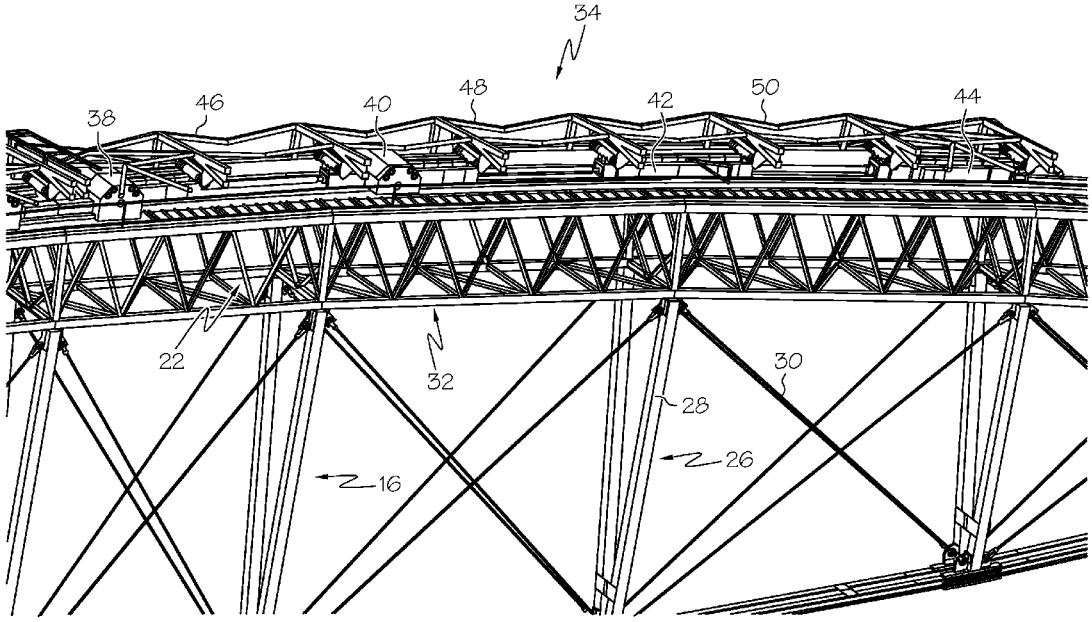
FIG. 4 is a fragmentary perspective view of a portion of the convertible stadium.
Figure 5:
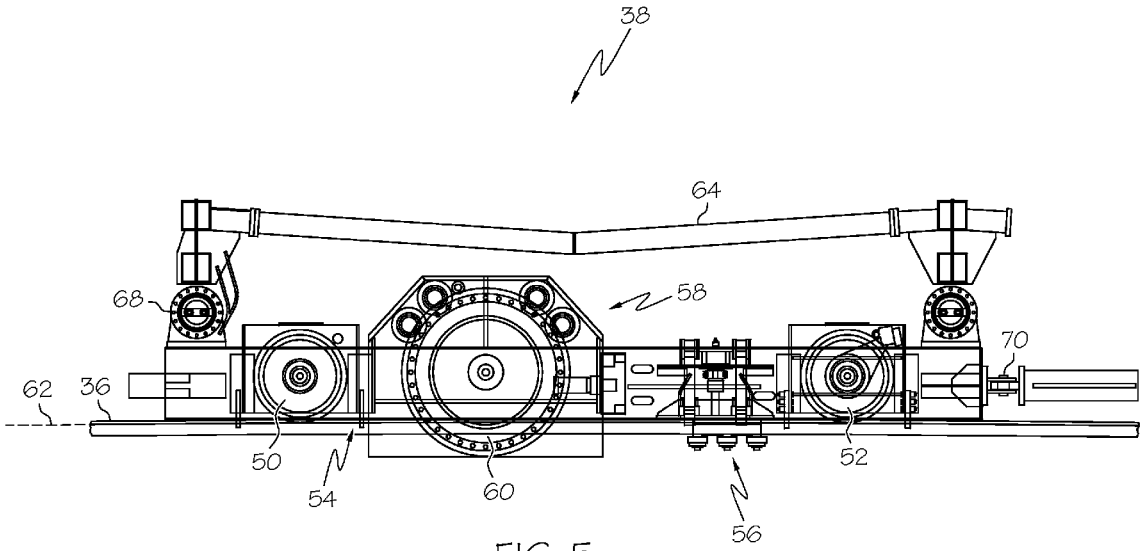
FIG. 5 is a cross-sectional view depicting a carrier unit according to the preferred embodiment.

The first and second movable roof panels 18, 20 are both mounted for movement along the path with respect to the stationary roof structure 16 by means of first and second parallel guide track assemblies 22, 24 that are provided at opposite lateral sides of the top of the stationary roof structure 16. Referring to FIG. 4, it will be seen that first guide track assembly 22 is supported by framework 26 that is part of the stationary roof structure 16 and that includes a plurality of struts 28 and tension rods 30. The guide track assembly 22 is supported and protected by a longitudinally extending box frame 32. Referring briefly to FIG. 5, it will be seen that a longitudinally extending rail member 36 is provided which, as is shown in FIG. 4, is rigidly secured to an upper end of box frame 32. Preferably, rail member 36 is inclined or curved so that the movable roof panels 18, 20 are biased by gravity and their own weight toward the fully open position. In the preferred embodiment, rail member 36 is convexly curved, and has a radius of curvature of at least 750 feet. In the most preferred embodiment, rail member 36 has a radius of curvature of approximately 1500 feet. The slope of the rail member 36 preferably varies within a range of about 0° to about 45°, and is more preferably within range of about 0° to about 25°. Most preferably, the slope of the rail member 36 varies within a range of about 0° to about 15°.

A carrier assembly 34 is mounted to travel along the path on each rail member 36. Carrier assembly 34 includes a first carrier unit 38, a second carrier unit 40, a third carrier unit 42 and a fourth carrier unit 44. A first linkage assembly 46, a second linkage assembly 48 and a third linkage assembly 50 are provided to securely link the carrier units 38, 40, 42, 44 to each other. The carrier units 38, 40, 42, 44 are secured to the lenticular roof panel 64 via linkages including linear bearings 66, 68, as is best shown in FIG. 5.

Referring again to FIG. 5, it will be seen that carrier unit 38 includes first and second rail follower wheels 50, 52 that are configured to ride upon the rail 36, a bumper assembly 54, a rail clamp assembly 56 and a cable drum assembly 58 having a cable drum 60 for paying out and retracting a cable 62 in controlled fashion as will be described in greater detail below. A coupling 70 is provided for coupling the carrier unit 38 to the linkage assembly 46 and to the other entrained carrier units 40, 42, 44 described above and that are depicted in FIG. 4.

Figure 6:
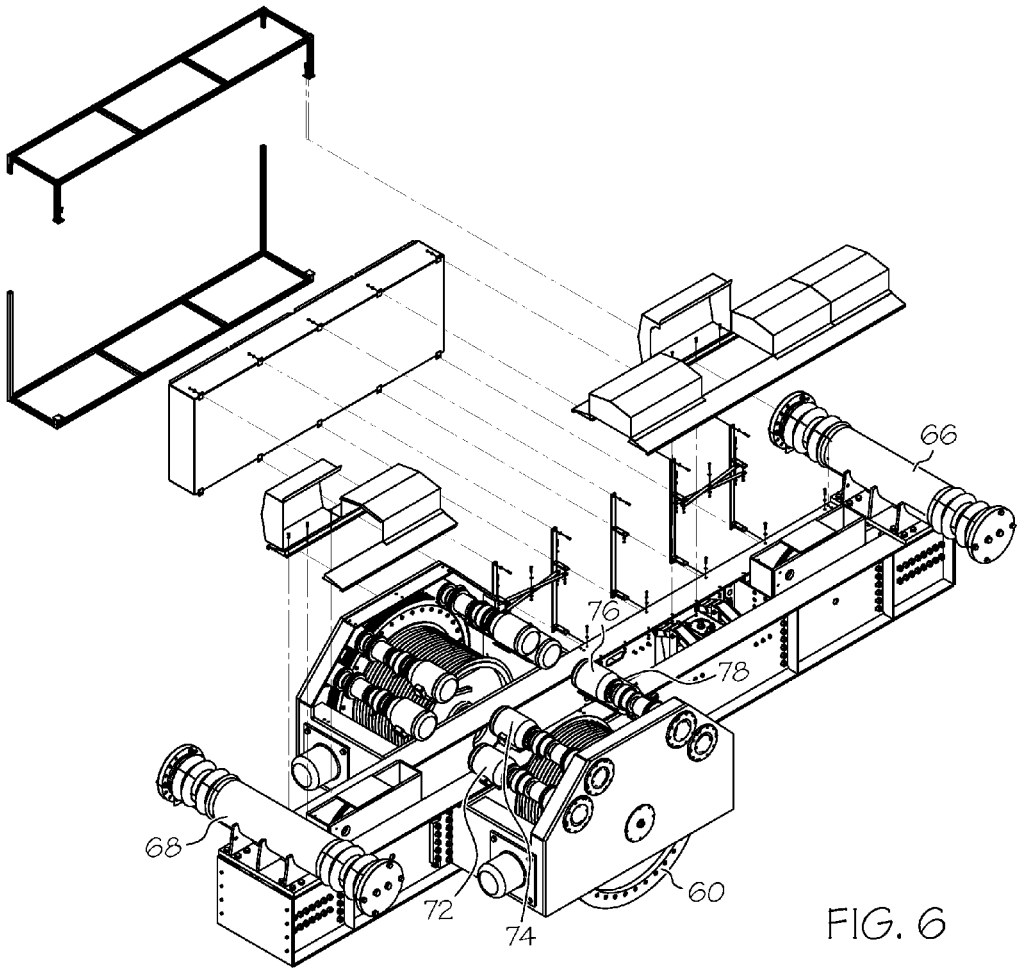
FIG. 6 is an exploded view depicting details of a carrier unit according to the preferred embodiment.

As is best shown in FIG. 6, each cable drum 60 is provided with four drive motors 72, 74, 76, 78. Each cable drum 60 will preferably drive one cable 62, with one end of the cable 62 being anchored to the cable drum 60 and a second end of the cable drum 62 preferably being anchored to an anchor location 80 that is near the top of the maximum height of vertical travel of the respective movable roof panel 18, 20, near the parting line between the roof panels 18, 20 when the roof panels 18, 20 are in the closed position. The anchor location 80 is best shown in FIGS. 2 and 3. In the system shown and described as the preferred embodiment, there will be a total of 16 cable drums and 16 cables, with eight cable drums and eight cables being provided for each of the first and second movable roof panels 18, 20. Each drive motor is preferably equipped with fail-safe electric brakes that, when engaged, will prevent the operable roof panel 18, 20 from moving under its own weight. An example of commercially available electric brakes that would be considered acceptable for this purpose is 45 ft-lb torque Kebco electric brakes. The expected maximum load on two cable and drum drive systems during operation or when holding the roof in place is about 85 kips.

The roof is preferably designed to be operational with up to one quarter of its motors failing, and to be stoppable with as many as nine out of 16 brakes failing. Each motor brake is equipped with a brake switch, a mechanically activated switch that changes state according to the position of the brake discs. This switch is monitored by the central control system and is used to report any mechanical failure of the brake to operate. The brake torque value or its ability to hold and stop the load is measured by briefly activating the motors against closed brakes and monitor the roof (via the absolute encoders mounted on each roof side) for any motion. Motion would indicate wear of the brake discs; the more motion or slip, the greater wear. This is used in the maintenance program to monitor brake wear and to signal a need for replacement.

Figure 7:
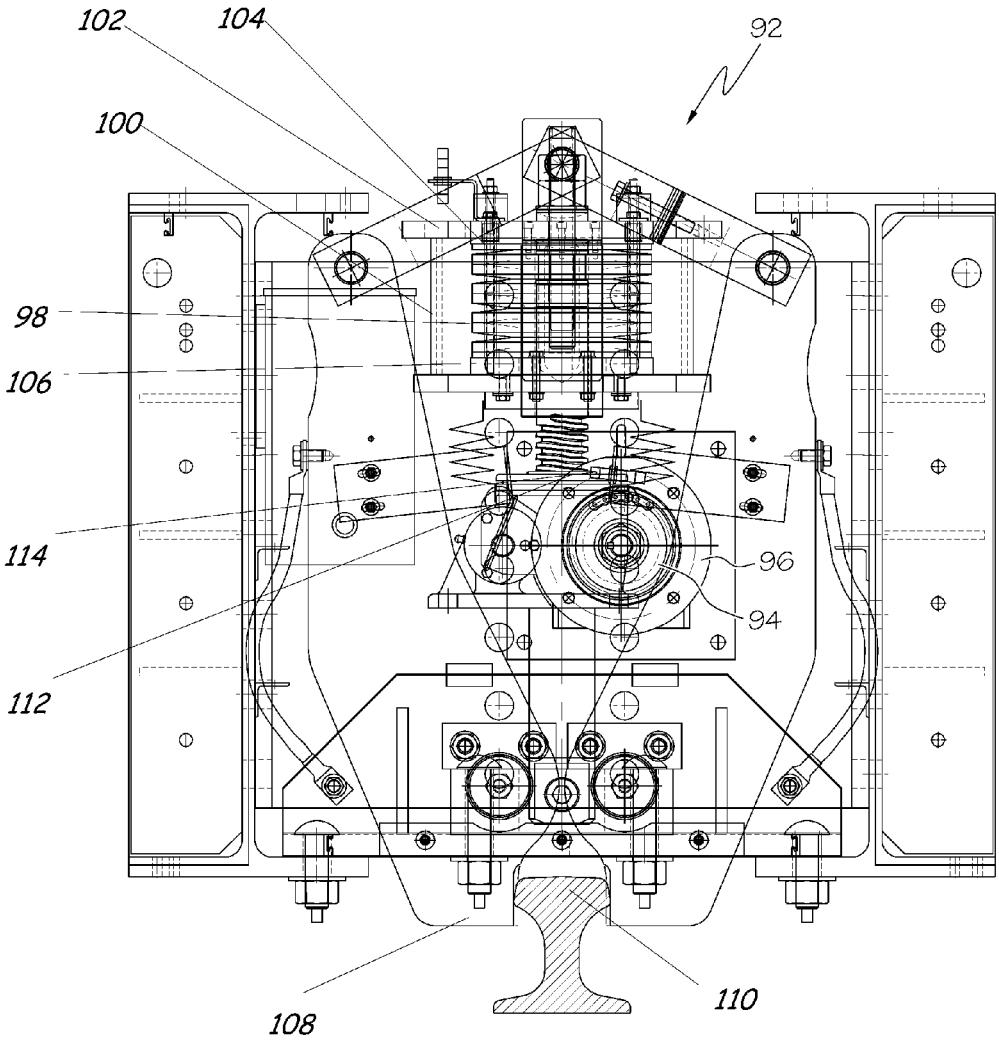
FIG. 7 is a cross-sectional view depicting a rail clamp assembly according to the preferred embodiment.

Referring to FIG. 7, each powered carrier unit 38, 40, 42, 44 will be equipped with one operable rail clamp assembly 92, which will engage after the movable roof panel 18, 20 comes to a complete stop and will prevent unwanted movement of the roof panel 18, 20. A machine screw jack 94 driven by an electric motor 96 will compress a stack 98 of seven 2009212, reduced thickness Belleville Springs stacked in a guide assembly. An inner guide tube 100 attached to the top plate 102 will provide alignment for the spring stack 98, and two hardened washers 104, 106 (one on top and one on the bottom) will provide a durable contact point during spring compression in release. The springs will distribute their load through the operable rail clamp assembly 92 and cause the tongs 108 to clamp on to the railhead 110. When the operable rail clamp 92 moves into the fully clamp position, a spreader beam 112 will actuate a proximity sensor 114, which will in turn stop rail clamp movement. The friction connection between the operable rail clamp tongs 108 and the railhead 110 will prevent the movable roof panel 18, 20 from moving laterally, and will also provide some uplift load resistance.

Figure 8:
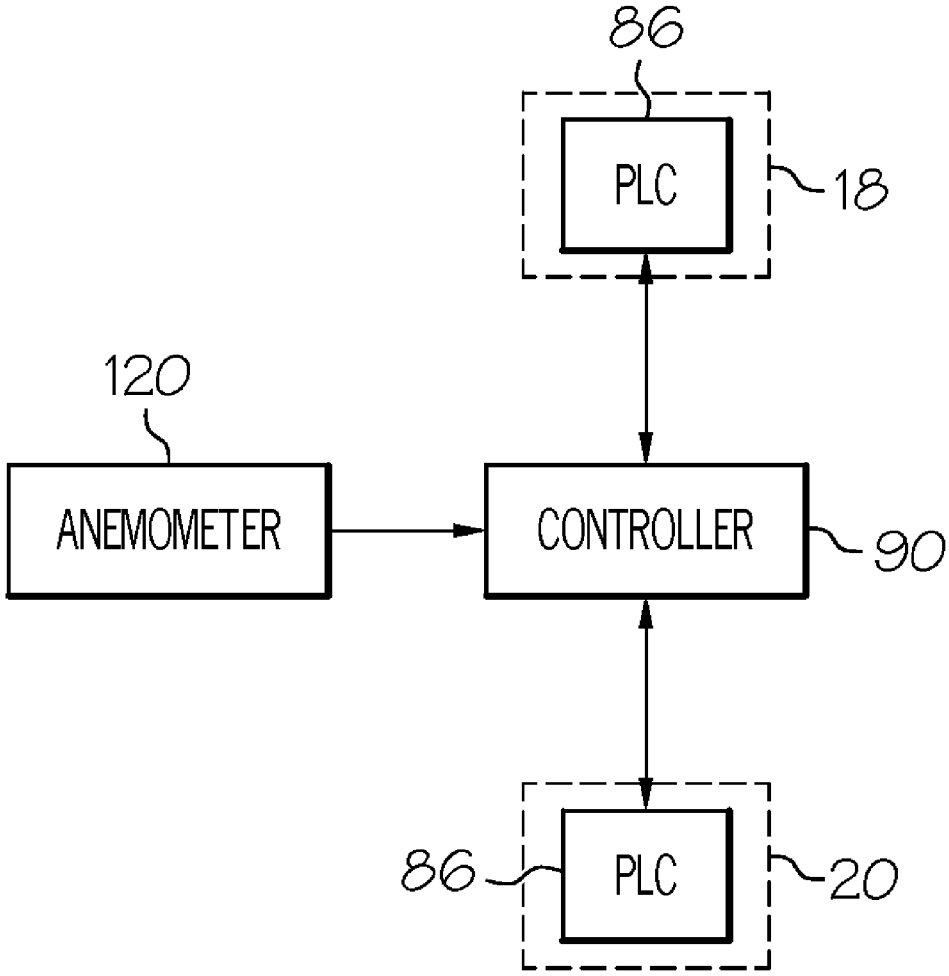
FIG. 8 is a schematic diagram depicting a control system for the convertible stadium according to the preferred embodiment.
Figure 9:
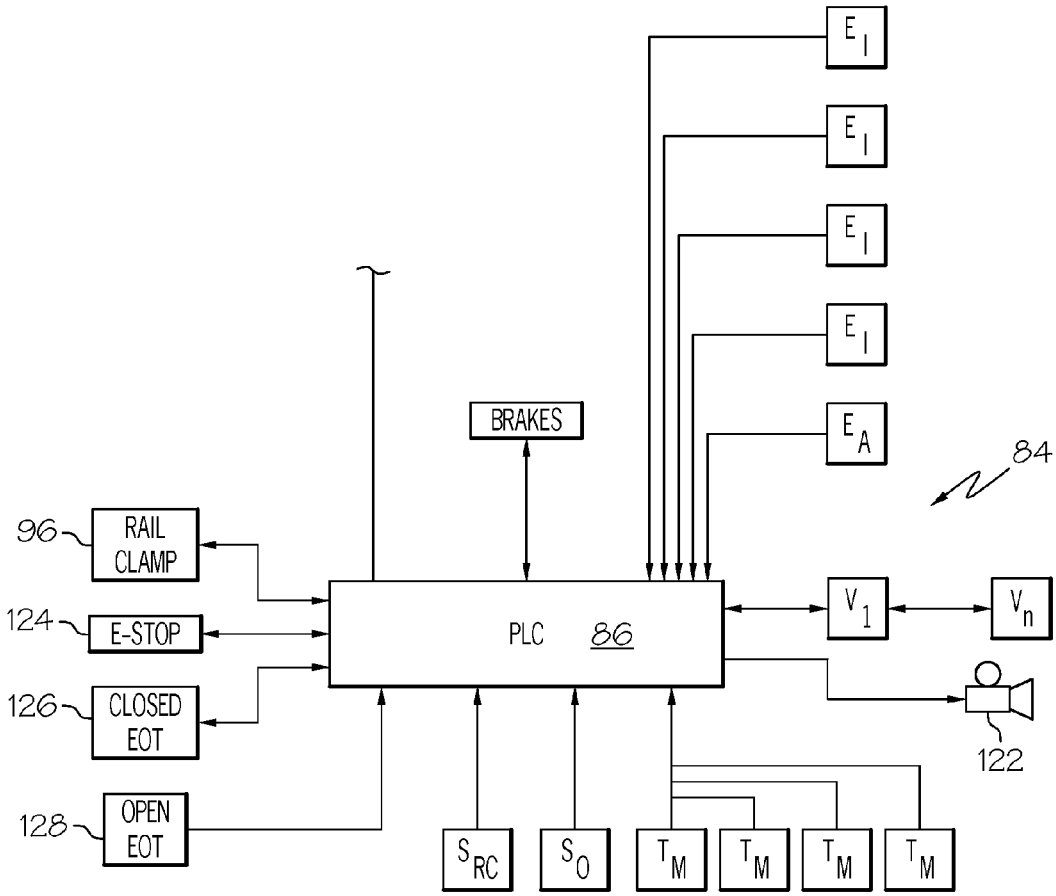
FIG. 9 is a schematic diagram depicting more details of the control system that is shown in FIG. 8.

FIGS. 8 and 9 schematically depict an electronic control system 84 that is provided in the preferred embodiment for monitoring and controlling movement of the first and second movable roof panels 18, 20. The electronic control system is constructed and arranged to compare movement of the first and second cable drums in order to maintain alignment of the roof panel with respect to the stationary roof structure as the roof panel travels thereover. Each roof quadrant will have eight variable frequency drives (VFD) V, each controlling the motor speed in the starting and stopping ramps for two motors. A Variable Frequency Drive captures conventional AC current and converts it to DC current, then reconstructs the sine wave of the current back to a regulated AC sine form. This feature is very useful in the acceleration/deceleration phase. For example, the VFD will start at 0 Hz and ramp up to full running speed (60 Hz or above) following a linear ramp or an 'S'-curve, thus protecting the structure from undue stress. Most 3-phase AC motors are 4-pole motors. Preferably, conventional 3-phase 4-pole motors are utilized, primarily because they are extremely economical to purchase. A conventional 4-pole motor when powered with 60 Hertz current always turns at about 1750 RPM. The relationship of the 4-poles and the alternating current at 60 Hertz is fundamental, and the machine will always seek to run at 1750 RPM. At these low speeds it is required to inject a higher voltage to maintain the torque output, which is also a function of the micro-processor within the VFD. This micro-processor can be adjusted to output frequency on a sliding scale. Example: If a linear ramp with a length of 20 seconds is used, the speed after 5 seconds will be 15 Hertz and after 20 seconds 60 Hertz. Thus, if the desired frequency was 90 Hertz, the total acceleration time would be 30 seconds and the motor would now run at 2625 RPM. This gives a gradual start, protecting the machinery, the building and all other mechanical equipment. The micro-processor is programmed based on predetermined calculations regarding the maximum torque and inertia that collateral equipment can withstand. It is a function of the stiffness of the building structure, the weight of the retractable roof, and the stiffness of the collateral machinery. The point is that the VFD is adjustable, and that by calculation the most favorable acceleration and/or deceleration curve may be determined.

The application of VFD's allows movement of the equipment to be commenced at a very slow speed, as well as to permit eventual acceleration of the equipment up to twice the normal speed of a standard 3-phase motor, thereby completing the cycle time at a much faster speed than a conventional arrangement. The VFD with the application of the Programmable Logic Controller (PLC) can also react to the wind in and around the stadium. If it is found that the wind is of an excessive speed the VFD may be prevented from accelerating past a slower speed, thus protecting all of the machinery. This application of both the VFD and the PLC allows the mechanism to complete the opening cycle most of the time in half the speed of a conventional machine, while still maintaining the capability to slow down to 60 Hertz where it has its optimal torque during high wind conditions to maintain safety. This arrangement is a significant improvement over conventional drives.

One VFD for each quadrant will be designated as the lead or master (shown as $V_1$, $V_2$ in FIG. 9), and will be linked by a dedicated fiber-optic link with the other seven follower VFDs. The Master receives a speed command from the central system and starts turning its cable drum while simultaneously feeding its own torque value as a command to the seven Follower VFDs. If a motor or a VFD on the Master Drum should fail, the roof will stop and the Master duties are transferred automatically to one of the other drums, after which an operator can restart the move. If a single motor on a VFD fails, the VFD is reset on the fly to half capacity, so as not to overload the remaining motor. Each of the follower VFDs will maintain a motor torque equal to that of its lead, which will ensure that all cables in each quadrant share the roof load equally.

Each movable roof panel 18, 20 will be equipped with its own programmable logic controller (PLC) 86, 88 that will work with the VFDs in that roof panel and control roof operation. In each drum group of four drums there are eight VFDs (16 motors). These 8 VFDs communicate with each other via a high-speed fiber-optic network and with the central roof control system via an industrial LAN. Each cable drum 60 will have an incremental encoder $E_I$ that will measure speed and direction of movement, as well as the incremental length of cable. Each roof quadrant will have an absolute encoder $E_A$ located on the lead carrier, which will track the respective roof panel's position on the rail, and will remember the position when the roof is powered down and back up again. Control system 84 will also preferably have a central controller 90 with an operator interface and that is in two way communication with each of the PLCs 86, 88. The PLC's 86, 88 control practically every aspect of operation of the opening and closing of the roof panels 18, 20, including operation of the rail clamps 96, the motors, the brakes and the monitoring of operating conditions. A sensor 126 is provided for enabling the PLC 86 to determine when the roof panel 18, 20 has reached the fully closed position, and a second sensor 128 is provided for enabling the PLC 86 to determine when the roof panel 18, 20 has reached the fully open position. Warning sirens and lights 122 are provided that are actuatable by the PLC to warn humans of dangerous or irregular conditions.

Another feature provided by the PLC, coupled to the VFD, is the ability for the operator to continuously monitor the motor voltage, the motor frequency, and the motor output torque. The motor thermostat $T_M$ for each motor is also in data communication with the PLC. This may permit estimation of the dynamic tension in each of the cables during operation. These figures are displayed on the operator's information screen and recorded continuously for historic reference and troubleshooting. These diagnostic features allow the operator confidence that the mechanism is functioning as intended and offer an early warning as soon as an inconsistency develops in the mechanism long before a serious failure would occur. The historical data logging is programmed to download through the internet on a high-speed communications link to a remote facility, thus enabling engineers at that facility to monitor all systems in the field to be sure they are working properly. The combination of these devices allows an unsophisticated owner with no engineering staff to operate highly technical equipment that heretofore could not be operated without a staff of engineers on-site, thereby significantly reducing the cost of ownership.

Each of the two sides of a stadium roof panel 18, 20 will preferably have its own local Emergency Stop (E-Stop) circuit 124 to cut off power to the drive systems and reset the motor brakes in case of an E-Stop condition. The control systems on the two roof sides are galvanically isolated from each other by a fiber-optic cable connecting the two data LANs. This is done for two reasons:

1. To limit the segment length of the data LAN (distance in a fiber-optic run is not counted, due to very small signal losses), and 2. To limit the component exposure in case of a lightning strike.

For the same reasons the two E-Stop circuits are preferably isolated by a fiber-optic connection. An E-Stop system consists of two redundant channels so that each E-Stop button has two contacts in the safety system. These channels are constantly monitored by a safety controller and a failure of either channel will result in an E-Stop condition. These two channels are carried between the two independent E-Stop systems as dual emitter-receiver fiber systems. If an E-Stop system is OK, it sends two independent light signals (different frequencies) through a single fiber to a pair of receivers on the other roof side. The two receivers each have an output contact which is part of the local E-Stop system. An identical, but opposite system, makes the second side part of the first side's E-Stop system. Thus any E-Stop trip will instantly cause a trip on both sides. This is important, since a fast stop on one side (caused by instant activation of motor brakes) and a slow stop on the other (by normal deceleration or a delayed fast stop commanded by the central system) could cause undue structural stress.

The installed roof will have an emergency stop system that will bypass the PLC's and VFDs and when activated, will disconnect all power to the motors and brakes, causing the failsafe, spring-set brakes to engage and stop the movable roof panel 18, 20 from moving.

Each quadrant will have one overspeed sensing system $S_O$ independent of the control system 84 that will stop the roof panel 18, 20 if it moves over the allowed speed. A disk with magnets embedded in the outer edge will be driven by a carrier wheel and will generate a pulse train as a drives past the sensor. If the pulse train goes above the allowed speed, power to the motors and brakes will be cut, causing the failsafe electric brakes to engage. Although the overspeed sensing system $S_O$ is independent of the control system 84 it still reports data to the responsible PLC for the particular roof panel 18, 20 to which it is attached.

Figure 10:
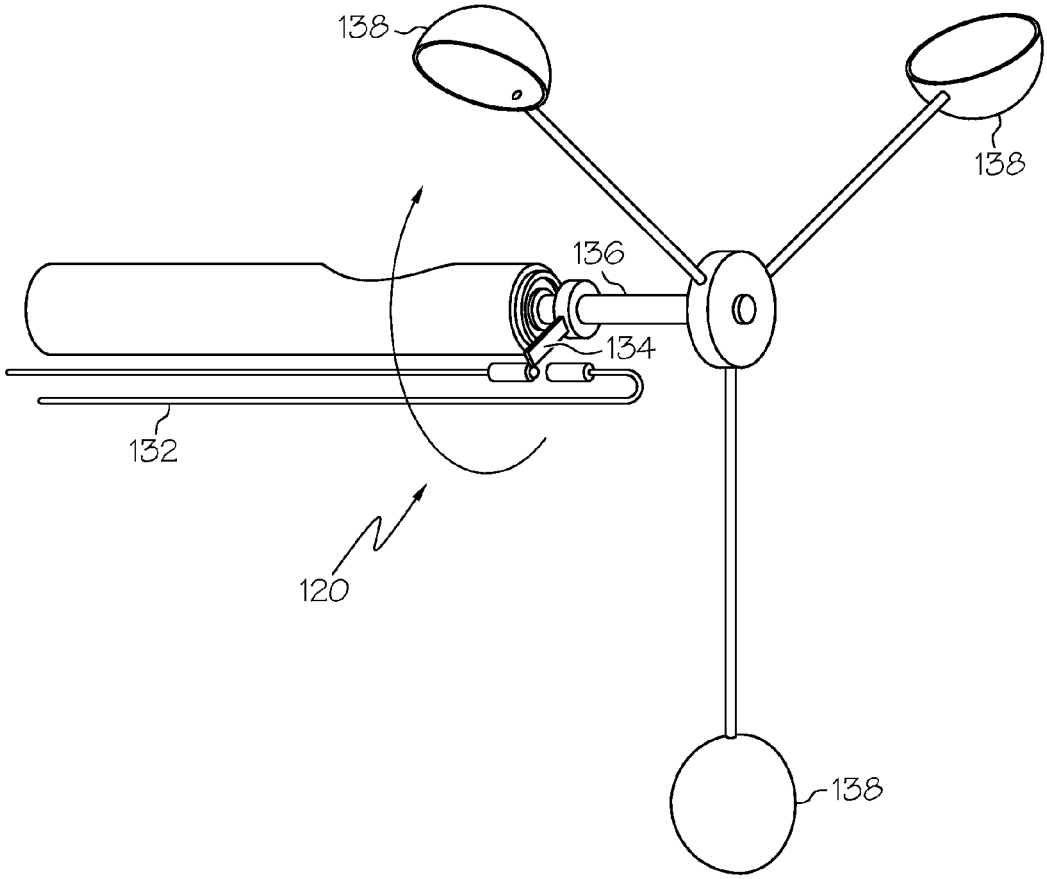
FIG. 10 is a diagrammatical depiction of an anemometer constructed according to a preferred embodiment of the invention.

Referring now to FIG. 10, the stadium roof is preferably equipped with an anemometer 120 to monitor the wind speed and to prevent roof motion when the wind speed exceeds the design values. Given the nature of the anemometer 120 it is generally mounted on to a very tall structure and as such is exposed to lightning strikes or, even in the absence of actual lightning strikes, to elevated electrostatic surges, which can destroy sensitive electronic circuits in modern anemometers. To eliminate this risk, an anemometer was designed which is entirely based on fiber-optic signals. An emitter/receiver pair is located below the roof line and the connected fiber-optic cable 132 runs up the anemometer mast to a pair of lenses separated by a small air gap. A mechanical "flag" 134 mounted on the shaft 136 that also holds the three anemometer cups 138 that are driven by the wind. The flag 134 interrupts the light beam every time the anemometer rotates one revolution. The receiver below the roof line (and out of harms way) sends the resulting electrical pulses to a counter which is part of the central control system 90.

Although the cable driving control system described herein has previously been described in connection with convertible stadiums, it should be understood that in alternative embodiments it could be used in any other large edifice in which a retractable roof panel could be employed.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A movable roof system, comprising:

a stationary roof structure;

a large, heavy roof panel mounted for movement along a path with respect to said roof structure;

a cable drum mounted for common movement as a unit along the path with said roof panel;

at least one electric motor constructed and arranged to drive the cable drum, the electric motor being mounted for common movement as a unit along the path with said roof panel; and a cable, said cable being secured to said stationary roof structure and being payable from said cable drum.

2. A movable roof system according to claim 1, wherein said at least one electric motor comprises a plurality of electric motors, all of which are engaged to drive said cable drum.

3. A movable roof system according to claim 1, further comprising an electronic control system for monitoring and controlling movement of said cable drum.

4. A movable roof system according to claim 1, further comprising a second cable drum mounted for movement with said roof panel; and a second cable, said second cable being secured to said stationary roof structure and being payable from said second cable drum.

5. A movable roof system according to claim 4, further comprising an electronic control system for monitoring and controlling movement of said first and second cable drums.

6. A movable roof system according to claim 1, further comprising a brake operably connected to said cable drum.

7. A movable roof system according to claim 1, wherein said roof panel is mounted for movement on a guide track, and wherein said guide track is inclined, and wherein said cable is maintained in tension against the bias of the weight of said roof panel.

8. A movable roof system according to claim 1, further comprising an overspeed sensing system, said the overspeed sensing system comprising means for sensing a speed of the roof panel relative to the stationary roof structure and braking means for arresting movement of the roof panel with respect to the stationary roof structure in the event that an overspeed condition is sensed.

9. A convertible stadium, comprising:

a playing field;

a seating area;

a stationary roof structure;

a large, heavy roof panel mounted for movement along a path with respect to said stationary roof structure;

at least one electric motor mounted for common movement along the path as a unit with said roof panel; and a plurality of cable drums, each of said cable drums being mounted for common movement as a unit together along the path with said roof panel, wherein at least one of the cable drums is driven by the electric motor and each of said cable drums has at least one cable wound thereabout, said cable being secured to said stationary roof structure and being payable from said respective cable drum.

10. A convertible stadium according to claim 9, wherein said at least one electric motor comprises a plurality of electric motors, all of which are engaged to drive said cable drum.

11. A convertible stadium according to claim 9, further comprising an electronic control system for monitoring and controlling movement of said cable drums.

12. A convertible stadium according to claim 11, wherein said electronic control system is constructed and arranged to monitor the angular position of the cable drums.

13. A convertible stadium according to claim 11, wherein said electronic control system is constructed and arranged to monitor angular speed and direction of movement of the cable drums.

14. A convertible stadium according to claim 11, wherein said electronic control system is constructed and arranged to monitor tension force in the cable.

15. A convertible stadium according to claim 11, wherein said electronic control system is constructed and arranged to detect undesired resonance in the system.

16. A convertible stadium according to claim 15, wherein said electronic control system is further constructed and arranged to attenuate undesired resonance in the system.

17. A movable roof system according to claim 11, wherein said electronic control system is constructed and arranged to compare movement of said first and second cable drums in order to maintain alignment of said roof panel with respect to said stationary roof structure as said roof panel travels thereover.

18. A convertible stadium according to claim 9 further comprising a brake operably connected to said cable drum.

19. A convertible stadium according to claim 9, further comprising an overspeed sensing system, said the overspeed sensing system comprising means for sensing a speed of the roof panel relative to the stationary roof structure and braking means for arresting movement of the roof panel with respect to the stationary roof structure in the event that an overspeed condition is sensed.

20. A convertible stadium according to claim 9, wherein said roof panel is mounted for movement on a guide track, and wherein said guide track is inclined, and wherein said cable is maintained in tension against the bias of the weight of said roof panel.

21. A movable roof system, comprising:

a stationary roof structure;

a large, heavy roof panel mounted for movement along a path with respect to said roof structure;

a cable drum mounted for common movement as a unit along a path with said roof panel;

a cable, said cable being secured to said stationary roof structure and being payable from said cable drum;

a second cable drum mounted for common movement as a unit along a path with said roof panel;

a second cable, said second cable being secured to said stationary roof structure and being payable from said second cable drum; and an electronic control system for monitoring and controlling movement of said first and second cable drums, wherein said electronic control system is constructed and arranged to monitor and compare the angular position of the first cable drum and the angular position of the second cable drum.

22. A movable roof system according to claim 21, wherein the electronic control system is further constructed and arranged to compare movement of the first and second cable drums in order to maintain alignment of the roof panel with respect to the stationary roof structure as the roof panel travels thereover.

23. A movable roof system, comprising:

a stationary roof structure;

a large, heavy roof panel mounted for movement along a path with respect to said roof structure;

a cable drum mounted for common movement as a unit along a path with said roof panel;

a cable, said cable being secured to said stationary roof structure and being payable from said cable drum;

a second cable drum mounted for common movement as a unit along a path with said roof panel;

a second cable, said second cable being secured to said stationary roof structure and being payable from said second cable drum; and an electronic control system for monitoring and controlling movement of said first and second cable drums, wherein said electronic control system is constructed and arranged to monitor and compare the angular speed and direction of movement of the first cable drum and the angular speed and direction of movement of the second cable drum.

24. A movable roof system according to claim 23, wherein said electronic control system is further constructed and arranged to attenuate undesired resonance in the system.

25. A movable roof system according to claim 23, wherein the electronic control system is further constructed and arranged to compare movement of the first and second cable drums in order to maintain alignment of the roof panel with respect to the stationary roof structure as the roof panel travels thereover.

26. A movable roof system, comprising:

a stationary roof structure;

a large, heavy roof panel mounted for movement along a path with respect to said roof structure;

a cable drum mounted for common movement as a unit along a path with said roof panel;

a cable, said cable being secured to said stationary roof structure and being payable from said cable drum;

a second cable drum mounted for common movement as a unit along a path with said roof panel;

a second cable, said second cable being secured to said stationary roof structure and being payable from said second cable drum; and an electronic control system for monitoring and controlling movement of said first and second cable drums, wherein said electronic control system is constructed and arranged to monitor and compare tension force in the first cable and tension force in the second cable.

27. A movable roof system according to claim 26, wherein the electronic control system is further constructed and arranged to compare movement of the first and second cable drums in order to maintain alignment of the roof panel with respect to the stationary roof structure as the roof panel travels thereover.

28. A movable roof system, comprising:

a stationary roof structure;

a large, heavy roof panel mounted for movement along a path with respect to said roof structure;

a cable drum mounted for common movement as a unit along the path with said roof panel;

a cable, said cable being secured to said stationary roof structure and being payable from said cable drum;

a second cable drum mounted for common movement as a unit along the path with said roof panel;

a second cable, said second cable being secured to said stationary roof structure and being payable from said second cable drum; and an electronic control system for monitoring and controlling movement of said first and second cable drums, wherein said electronic control system is constructed and arranged to detect undesired resonance in the system.

29. A movable roof system according to claim 28, wherein the electronic control system is further constructed and arranged to compare movement of the first and second cable drums in order to maintain alignment of the roof panel with respect to the stationary roof structure as the roof panel travels thereover.

30. A movable roof system, comprising:

a stationary roof structure;

a large, heavy roof panel mounted for movement along a path with respect to said roof structure;

a cable drum mounted for common movement as a unit along the path with said roof panel;

a cable, said cable being secured to said stationary roof structure and being payable from said cable drum; and an overspeed sensing system, said the overspeed sensing system comprising means for sensing a speed of the roof panel relative to the stationary roof structure and braking means for arresting movement of the roof panel with respect to the stationary roof structure in the event that an overspeed condition is sensed.

31. A movable roof system according to claim 30, wherein the electronic control system is further constructed and arranged to compare movement of the first and second cable drums in order to maintain alignment of the roof panel with respect to the stationary roof structure as the roof panel travels thereover.

32. A movable roof system, comprising:

a stationary roof structure;

a large, heavy roof panel mounted for movement along a path with respect to said roof structure;

a cable drum mounted for common movement as a unit along the path with said roof panel;

a cable, said cable being secured to said stationary roof structure and being payable from said cable drum;

a second cable drum mounted for common movement as a unit along the path with said roof panel;

a second cable, said second cable being secured to said stationary roof structure and being payable from said second cable drum; and an electronic control system for monitoring and controlling movement of said first and second cable drums, wherein said electronic control system is constructed and arranged to compare movement of said first and second cable drums in order to maintain alignment of said roof panel with respect to said stationary roof structure as said roof panel travels thereover.

33. A convertible stadium, comprising:

a playing field;

a seating area;

a stationary roof structure;

a large, heavy roof panel mounted for movement along a path with respect to said stationary roof structure;

a plurality of cable drums, each of said cable drums being mounted for common movement as a unit together along the path with said roof panel, wherein each of said cable drums has at least one cable wound thereabout, said cable being secured to said stationary roof structure and being payable from said respective cable drum and wherein said roof panel is mounted for movement on a guide track, and wherein said guide track is inclined, and wherein said cable is maintained in tension against the bias of the weight of said roof panel.

* * * * *